US008840969B1

(12) United States Patent
Giloh

(10) Patent No.: US 8,840,969 B1
(45) Date of Patent: Sep. 23, 2014

(54) METHOD AND APPARATUS FOR ADJUSTING THE RELATIVE MOVEMENT BETWEEN FLOCKING FIBERS AND FLOCKED OBJECTS

(71) Applicant: Tamicare Ltd., Heywood (GB)

(72) Inventor: Ehud Giloh, Manchester (GB)

(73) Assignee: TamiCare Ltd., Heywood (GB)

( * ) Notice: Subject to any disclaimer, the term of this patent is extended or adjusted under 35 U.S.C. 154(b) by 0 days.

(21) Appl. No.: 13/788,095

(22) Filed: Mar. 7, 2013

(51) Int. Cl.

| | |
|---|---|
| ***B05D 1/06*** | (2006.01) |
| ***B05D 1/14*** | (2006.01) |
| ***B05D 1/16*** | (2006.01) |
| ***B05C 19/00*** | (2006.01) |

(52) U.S. Cl.
CPC ..... *B05C 19/001* (2013.01); *B05D 1/14* (2013.01)
USPC ..... 427/462; 427/206

(58) Field of Classification Search
USPC ..... 427/206, 462
See application file for complete search history.

(56) References Cited

U.S. PATENT DOCUMENTS 3,591,403 A * 7/1971 Sheehan ..... 427/463
3,678,894 A * 7/1972 Walsh ..... 118/624

FOREIGN PATENT DOCUMENTS

GB 1 098 035 A2 1/1968

* cited by examiner

*Primary Examiner* — Frederick Parker
(74) *Attorney, Agent, or Firm* — McDonnell Boehnen Hulbert & Berghoff LLP

(57) ABSTRACT

A method and apparatus for adjusting the relative movement between flocked fibers and an object to be flocked is disclosed. Fibers move along a curved or arcuate path which includes both vertical and horizontal movement of the fibers from a flocking machine to the object to be flocked. The method improves the flocking process quality and increases production speed and output.

6 Claims, 2 Drawing Sheets

Current Invention
Method and
Apparatus

METHOD AND APPARATUS FOR ADJUSTING THE RELATIVE MOVEMENT BETWEEN FLOCKING FIBERS AND FLOCKED OBJECTS

BACKGROUND

When a moving object is flocked with loose fibers by a flocking machine (such as Maagflock FF 380-430 flat flocker from Maag Flockmaschinen GmbH, Kusterdingen, Germany), some inadequacy is created by the fact that the object has a longitudinal speed, due to the design of the flocking machine. The electrostatic flocking process uses electrostatic forces between the fibers themselves and between the fibers and the object. Some time is required for the attraction/repulsion forces to affect the position and placement of the fibers evenly into the object. As a result of the horizontal speed difference between the object and the fibers, there is less of a possibility for the fibers to penetrate properly and evenly into the object, hence the flocking quality is ruined. Moreover, the fibers hit the object while the object is moving so the front end of the fibres is pulled forward, in the machine direction. As a result, the fibers are anchored in a slanted position, covering a larger object surface area preventing more fibers to be anchored. The result is a poor flocking density, coverage, and quality. The larger the machine speed difference between the fibers and the object, the lower the flocking quality. This consequently limits the speed and the output of flocking process in a manufacturing line.

SUMMARY

This invention discloses a method and apparatus to overcome the shortcomings of the current technology by providing a way to control and adjust the relative longitudinal speed between flocked fibers and a flocked object, therefore substantially reducing the relative longitudinal movement between the object and the fibers hitting the object. This results in better flocking quality at a higher speed of the flocked objects, and may also increase manufacturing speed.

The disclosed apparatus comprises a device which acquires the horizontal movement of the flocked fibers along the machine direction. The fibers, after leaving the flocking machine and on their way towards the flocked object, are moving horizontally and vertically simultaneously. As a result, the difference in longitudinal speed between the object and the fibers is minimized, allowing for a greater chance of the fibers to be anchored into the object in a more even and vertical manner.

The method and apparatus of the present application allows for the adjustment of the horizontal, machine direction 'speed component' of the fibers, thus allowing for the adjustment of the relative longitudinal speed between the object and the fibers. This ability to adjust the horizontal speed component of the fibers improves flocking process quality and increases production speed and output.

As defined herein, the term "longitudinal speed" refers to the horizontal component of the speed between the fibers and the object to be flocked.

DETAILED DESCRIPTION

Figure 1:
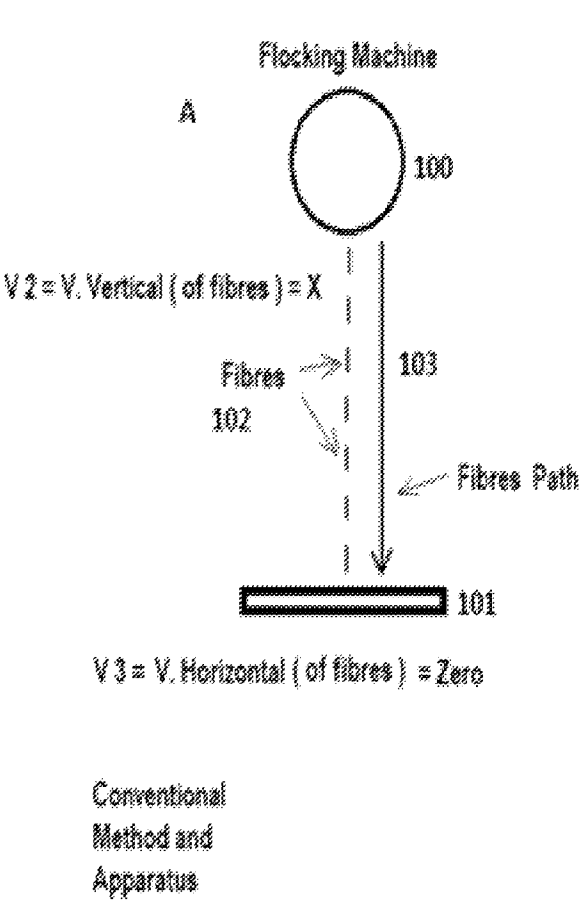
Fig. 1 Prior Art
FIG. 1 shows a trajectory of fibers in the air of a prior art flocking machine.
Figures 3, 4:
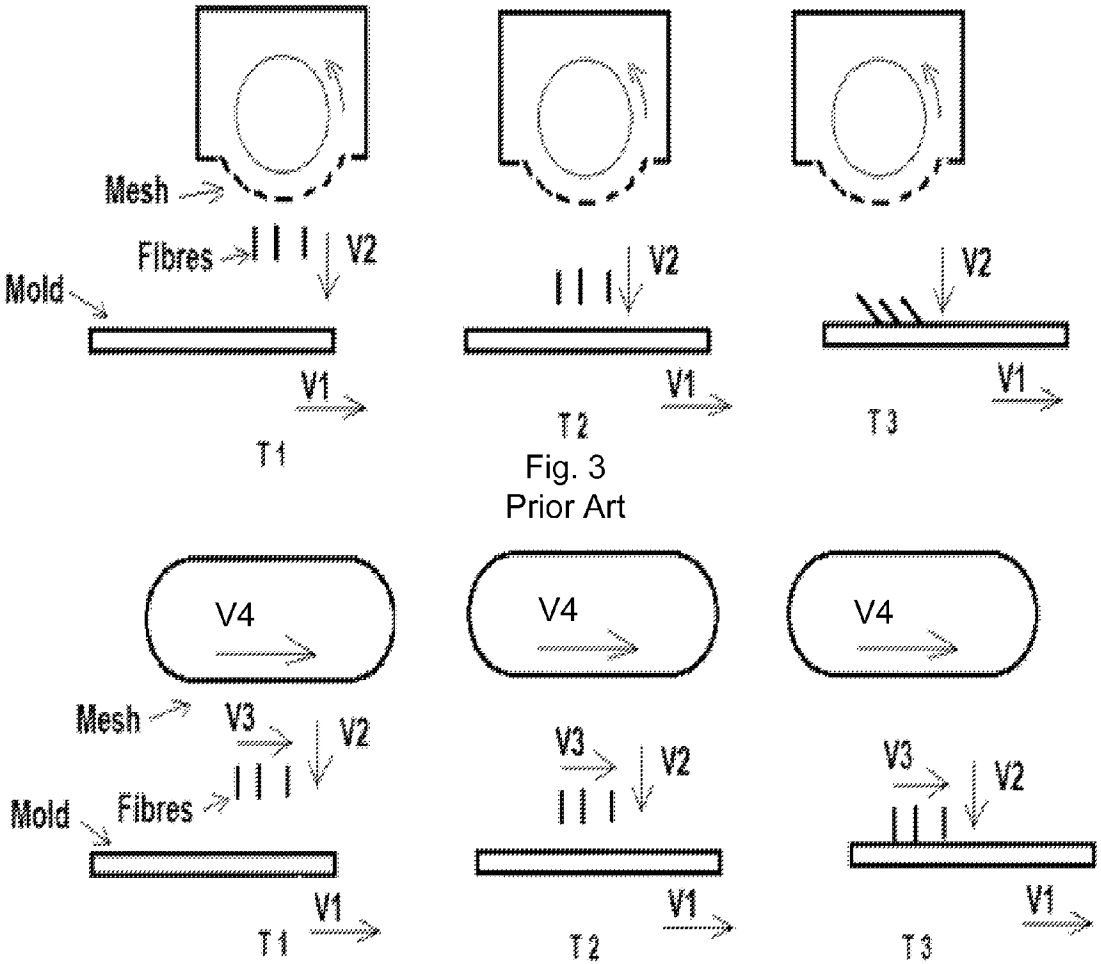
Fig. 3 Prior Art
FIG. 3 shows a trajectory of fibers and an object along the flocking process in a prior art apparatus for flocking fibers.
FIG. 4 shows a trajectory of fibers and an object along the flocking process in an apparatus for flocking fibers in accordance with the present application.

Referring to the Figures, FIGS. 1 and 3 show a prior art flocking machine 100 and an apparatus and method for flocking fibers. In conventional flocking techniques, fibers 102 move solely along a vertical path 103 to an object to be flocked 101. There is no horizontal movement of the fibers. In these Figures, V2 represents the vertical speed component (in vector terms) of the fibers 102, which is created by gravity and by the electrostatic attraction between the fibers and the object. The vertical speed V2 of the fibers in both the prior art system and the disclosed system is substantially equal. V3 represents the longitudinal speed of the fibers, which is typically zero in prior art systems (FIGS. 1 and 3).

Figure 2:
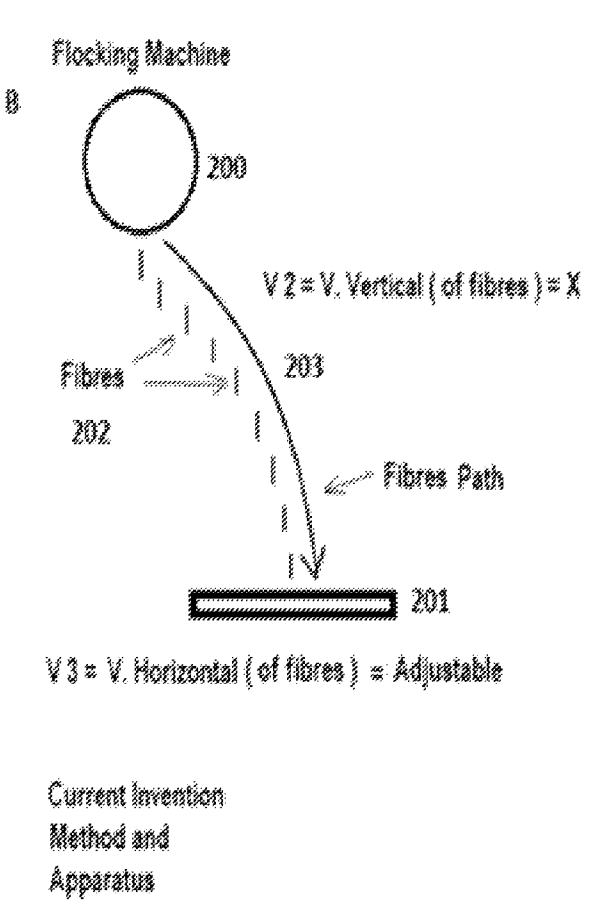
FIG. 2 shows a trajectory of fibers in the air of a flocking machine in accordance with the present application.

As shown in FIG. 2, fibers 202 move along a curved or arcuate path 203 which includes both a vertical V2 and a horizontal V3 speed component of the fibers from a flocking machine 200 to an object to be flocked 201. V2 is the vertical speed component (in vector terms) of the fibers created by gravity and by the electrostatic attraction between the fibers and the object. The vertical speed of the fibers in this system is substantially equal to the vertical speed in the prior art system. V3 represents the longitudinal speed component of the fibers which is controlled and adjustable in the disclosed system.

FIGS. 3 and 4 show the angle in which the fibers are embedded in the object in both systems. V1 represents the longitudinal speed of the object, which may be a mold. T1 is the time when the fibers leave the flocking machine 200, T2 represents the time where the fibers are on their way to the object to be flocked 201, and T3 represents the time when the fibers reach the flocked object.

Referring to FIG. 4, an apparatus 200 comprises a device which allows for horizontal movement of flocked fibers, along the machine direction. The fibers 202, after they leave the flocking machine 200 and on their way towards the flocked object 201, move horizontally (forward) and vertically (downward), at the same time, which creates the fibers' path 203. Therefore, the path 203 is curved or arcuate as shown in FIG. 2.

In one embodiment, the apparatus 200 is a moving mesh. The mesh moves at a speed of V4 in the horizontal direction, in the machine direction, to closely match the longitudinal speed V1 of the object 201, and the speed of the fibers may be controlled and adjustable to be similar, slightly faster, or slightly slower than the longitudinal speed V3 of the object.

In one embodiment, when the flocking is performed on a continuous moving object or objects which are very close to each other, such as a conveyor belt or a group of objects moving closely together, the mesh may be designed as a rotating mesh carousel, moving on a horizontal, cross machine direction axis, and the rotating mesh rotates continuously.

In another embodiment, when there are enough gaps between the objects to be flocked, the mesh may be designed to move forward, in the machine direction, during the flocking stage, and backwards to its original position during the phases between each flocking session, in intervals.

In another embodiment, the horizontal speed V3 of the fibers, at their starting point on their way down from the flocking machine to the object, may be set to be faster than the object horizontal speed to compensate for the reduction of the longitudinal speed V3 of the fibers, created by air resistance. This results in better horizontal speed matching when the fibers hit the object.

In yet another embodiment, the apparatus may comprise a monitoring system to provide real time monitoring of the longitudinal speed of the fibers along the flocking process. The monitoring system may include any suitable vision system, including an industrial vision system. The industrial vision system may comprise ultra-violet light, a stroboscopic device, or any other suitable tools to assist viewing.

In yet another embodiment, an industrial vision software may be employed to adjust the longitudinal speed V3 of the fibers 202 according to desired results in a pre-set mode or in real time.

In one embodiment, the fibers 202 are provided with inertia and movement in the longitudinal, machine direction by blowing air in the flocking machine 200.

In another embodiment the fibers 202 are provided with inertia and movement in the longitudinal, machine direction by blowing air in the flocking area.

In yet another embodiment the fibers 202 are provided with inertia and movement in the longitudinal, machine direction by blowing gas in the flocking machine 200.

In yet another embodiment the fibers 202 are provided with inertia and movement in the longitudinal, machine direction by blowing gas in the flocking area.

In yet another embodiment the fibers 202 are provided with inertia and movement in the longitudinal, machine direction by blowing by electrostatic or magnetic power, or by a combination of both.

The invention claimed is:

1. A method for flocking moving objects, the method comprising:

providing flocking fibers with inertia and movement in a longitudinal, machine direction, so the difference between a longitudinal speed of a moving object to be flocked and a longitudinal speed of the flocking fibers during the flocking process is minimized, thereby improving the flock density and quality relative to not providing the flocking fibers with inertia and movement in a longitudinal, machine direction.

2. The method according to claim 1, further comprising controlling and adjusting the longitudinal, machine direction speed of the flocking fibers to substantially match the speed of the moving object to be flocked.

3. The method according to claim 2, further comprising monitoring the longitudinal, machine direction speed of the fibers.

4. The method according to claim 1, further comprising providing a moving mesh that moves in the machine direction during said flocking process, a gas, or electrostatic or magnetic power, or a combination of at least two of the foregoing to provide said fibers with said inertia and movement in said longitudinal, machine direction.

5. The method according to claim 4, wherein said mesh is a rotating mesh carousel moving on a horizontal, cross machine direction axis, and wherein said rotating mesh rotates continuously.

6. The method according to claim 4, wherein said mesh moves forward from an original position in said machine direction during the flocking process, and backwards to the original position during phases between each flocking process.

* * * * *